US007523576B1

(12) United States Patent
Petty

(10) Patent No.: US 7,523,576 B1
(45) Date of Patent: Apr. 28, 2009

(54) POINT-OF-PURCHASE PROMOTIONAL ARTICLE

(75) Inventor: Catherine A. Petty, Port Barrington, IL (US)

(73) Assignee: The Meyers Printing Companies, Inc., Minneapolis, MN (US)

( * ) Notice: Subject to any disclaimer, the term of this patent is extended or adjusted under 35 U.S.C. 154(b) by 0 days.

(21) Appl. No.: 11/742,894

(22) Filed: May 1, 2007

Related U.S. Application Data

(60) Provisional application No. 60/746,106, filed on May 1, 2006.

(51) Int. Cl.
*G09F 3/14* (2006.01)

(52) U.S. Cl. ..... 40/664; 40/6; 24/16 PB

(58) Field of Classification Search ..... 40/664, 40/668, 665, 645, 6, 300, 633; 24/16 PB, 24/17 R, 17 AP; D8/394
See application file for complete search history.

(56) References Cited

U.S. PATENT DOCUMENTS

| | | | | |
|---|---|---|---|---|
| 627,920 | A * | 6/1899 | Gould | 40/665 |
| 2,016,059 | A | 10/1935 | Stevens | |
| 2,183,799 | A * | 12/1939 | Wenk, Jr. | 292/315 |
| 2,768,458 | A * | 10/1956 | Anania | 40/665 |
| 3,130,462 | A * | 4/1964 | Mitchell | 24/16 PB |
| 3,550,295 | A | 12/1970 | Anania | |
| 3,837,101 | A | 9/1974 | Young | |
| 4,142,310 | A | 3/1979 | Groselak et al. | |
| 4,149,329 | A | 4/1979 | Graves | |
| 4,510,649 | A * | 4/1985 | Yudis et al. | 24/16 PB |
| 4,630,384 | A | 12/1986 | Breen | |
| 4,761,904 | A * | 8/1988 | Fast et al. | 40/308 |
| 4,869,007 | A * | 9/1989 | Fast | 40/664 |
| 5,129,617 | A | 7/1992 | MacWilliamson | |
| 5,381,617 | A | 1/1995 | Schwartztol et al. | |
| 6,401,304 | B1 | 6/2002 | Dossett | |
| 7,263,790 | B2 * | 9/2007 | Richards | 40/306 |

* cited by examiner

*Primary Examiner*—Gary C Hoge
(74) *Attorney, Agent, or Firm*—Nawrocki, Rooney & Sivertson, P.A.

(57) ABSTRACT

A promotional hang tag having clasping and flag portions and a line-of-weakness delimiting the portions in furtherance of disengaging the flag portion from the clasping portion is provided. The clasping portion includes an anchor and an anchor retainer. The anchor retainer includes an elongate slot and opposingly paired slits extending from opposing ends of the elongate slot. The elongate slot is characterized by an axis of elongation and is dimensioned to receive a free end portion of the anchor, the anchor received by the anchor retainer and retained within the elongate slot.

6 Claims, 4 Drawing Sheets

POINT-OF-PURCHASE PROMOTIONAL ARTICLE

This is a regular application filed under 35 U.S.C. §111(a) claiming priority under 35 U.S.C. §119(e) (1), of provisional application Ser. No. 60/746,106, filed May 1, 2006, and incorporated herein by reference in its entirety.

TECHNICAL FIELD

The present invention generally relates to point-of-purchase promotional articles, more particularly, to a promotional hang tag supportable upon or supported by merchandise via integration of anchor and anchor receiving elements thereof, and more particularly still, a promotional hang tag having a portion thereof separable from a clasping or anchoring portion of the merchandise supported promotional hang tag.

BACKGROUND OF THE INVENTION

Considerable resources are directed to product promotions. As a threshold matter, merchandise and/or product labeling, marking, and packaging are critical initial and ongoing considerations. Arguably, naming, visual identity creation, branding and cross-branding are essential ingredients for strong marketplace differentiation intended to influence the purchasing behavior of consumers.

A variety of well-known point-of-purchase and promotional products are available. For instance, vehicles for advertising and promoting products, grabbing the attention of consumers, and/or prompting impulse or first time purchases include, but are hardly limited to, static clings, tent cards, shelf talkers, hanging mobiles, bottle neckers, hanging tags, instant redeemable coupons, etc.

With regard to equipping, adorning, outfitting, etc. a product with a promotional article, as for instance by causing same to be supported, carried, suspended, adhered, dangled etc. therefrom, or thereby, as the case may be, form generally fits function. As should be readily appreciated, unique problems are present within any given class of promotional device, article, or assembly, e.g., hang tags on the one hand versus a bottle necker on the other hand, and, occasionally, a "solution" to a particular "problem" warrants a shift in approach or tactic, i.e., replacing or supplanting one approach for another, e.g., a switch from a hang tag to a bottle necker or vice versa.

Hang tags are ubiquitous market place communication devices. A fundamental consideration for such tags are their interface with a product, i.e., the merchandise. For a class of articles that are supported by a portion or element of a product, or product package (i.e., danglers), the articles are typically characterized by either a band, e.g., a fixed length or reversibly expandable element, which tensioningly engages the merchandise or portion thereof, or by selectively integratable or cooperatively engageable components (e.g., clasp or clasping elements) which wrap about or ensnare at least a portion of the merchandise.

Numerous tagging or marking articles contemplate tag and tail sections which cooperate in some fashion so as to loop about or otherwise capture at least a portion of an article of manufacture. For example, U.S. Pat. Nos. 2,016,059 (Stevens), 4,149,329 (Graves), 5,129,617 (MacWilliamson), and 6,401,304 (Dossett) generally disclose merchandise tagging articles having an indicia bearing portion from which extends a tail or strap portion. Operatively, a barbed or otherwise configured free end of the strap is received for retention within an aperture of the tag portion so as to form a suspending or clasping structure for the article. Commonly, the barbed or otherwise configured free end of the strap is received within a stylized aperture (e.g., see Stevens, or MacWilliamson), or a more traditional geometrically shaped aperture such as a rectangle (e.g., see Graves) or a circle (e.g., see Dossett), with the nature of the barbed insertion therethrough being one of compliant deflection (i.e., substantial deformation of elements of the free end of the strap upon aperture engagement and initial ingress).

Beyond merchandise tagging, a further, well-known tagging environment is that associated with luggage or baggage, more particularly, "handled" articles. For instance, U.S. Pat. Nos. 3,550,295 (Anania), 3,837,101 (Young), 4,142,310 (Groselak et al.), 4,630,384 (Breen), and 5,381,617 (Schwartztol et al.), are all generally directed to self-locking baggage or luggage tags. Characteristically, such articles are known to have an elongate configuration, an indicia bearing area generally intermediate the end portions thereof, an aperture for receiving a free end of the article therethrough, and a portion or segment adapted to form an interference fit with the aperture. In this tagging environment, free strap ends, highly stylized (e.g., Anania and Young) or otherwise (e.g., Schwartztol et al.), may be received within an aperture, highly stylized (e.g., Anania and Young) or otherwise (e.g., Schwartztol et al.), some of which cooperatively engage same so as to form an interference fit (e.g., Anania and Young). Alternately, opposing side edges of an intermediate portion of the article may be adapted, via inclusion of a series of spaced apart slits (e.g., Groselak et al.) or slots (e.g., Breen), for forming an interference fit with an aperture of the article.

In light of the foregoing, and no doubt numerous alternative tagging solutions, there remains a need for quick, intuitive, instinctive, self-locking in/for a tagging article. Furthermore, there remains room for improvement with regard to a reliable, secured locked interface for portions or elements for such devices, namely, the interface between the engageable elements thereof, advantageously, a less is more solution. Additionally, and in furtherance of merchandise differentiation, it is believed advantageous to produce a printed marking tag via a sheet fed or web press, with or without over-laminates, that yield attention grabbing promotional vehicles. Further still, it is believed desirable to provide a promotional hang tag having a selectively disengageable flag, coupon, etc., more particularly, an article having an advantageous tension between the aforementioned characteristics or qualities, e.g., an article possessing a quick, supremely efficient clasp forming portion, and a reliably secure clasp so formed which can readily withstand disintegration of a marketing premium element thereof. Yet further still, it is believed particularly advantageous to provide a promotional article for selectively accompanying packaged snacks in lieu of integrally formed or direct promotional package print, more generally, it is believed advantageous to provide a novel mechanism or article to deliver promotions on a snack bag or the like.

SUMMARY OF THE INVENTION

A promotional hang tag having clasping and flag portions, and advantageously but not necessarily, a line-of-weakness delimiting the portions in furtherance of disengaging the flag portion from the clasping portion, is provided. The clasping portion includes an anchor and an anchor retainer. The anchor retainer includes an elongate slot and opposingly paired slits extending from opposing ends of the elongate slot. The elongate slot is characterized by an axis of elongation and is dimensioned to receive a free end portion of the anchor, the anchor received by the anchor retainer and retained within the elongate slot.

Alternately, a point-of-purchase promotional article comprising dominant and subordinate information conveyance portions is provided. The subordinate information conveyance portion includes a base and a strap extending therefrom, the strap terminating in a barbed free end. The base includes an elongate aperture and slits extending toward the dominant information conveyance portion from ends of the elongate aperture at acute angles. A portion of the barbed free end is insertably receivable within the elongate aperture, the barbed free end passable through the elongate aperture upon deflection of the slits, an interference fit between the barbed free end and the elongate aperture thereby formed.

Further still, a marking hang tag article, suspendable from merchandise, is provided. The article generally includes an information panel from which extends a strap having a barbed free end. A first portion of the information panel includes a centrally positioned slot and slits laterally extending from opposing ends of the slot, and away from the barbed free end of the strap. The barbed free end of the strap is readily received by and through the centrally positioned slot via passage of portions thereof through the slits. A second portion of the information panel, opposite the barbed free end, is selectively separable from the first portion of the information panel.

More specific features and advantages obtained in view of the summary features will become apparent with reference to the drawing figures and DETAILED DESCRIPTION OF THE INVENTION.

BRIEF DESCRIPTION OF THE DRAWINGS

Referring now to the drawings wherein like numerals are used to designate like parts of the invention throughout the figures.

DETAILED DESCRIPTION OF THE INVENTION

With general reference to the figures, namely, FIGS. 1-4, there is shown a preferred, non-limiting embodiment of the subject invention (FIG. 1), and a sequence (FIGS. 2-4) depicting progressive, cooperative engagement of elements thereof. For the sake of context, in as much as the article of FIG. 1, and variants thereof, have many advantageous applications, both in relation to the kind/character of articles of manufacture to which they might depend, and with respect to the content of a preferred, but not essential, disintegratable (i.e., separable) element thereof, it has proven especially advantageous to "dangle" the article of FIG. 1 from a product package, for instance and without limitation, a "snack sack" or the like.

Figure 1:
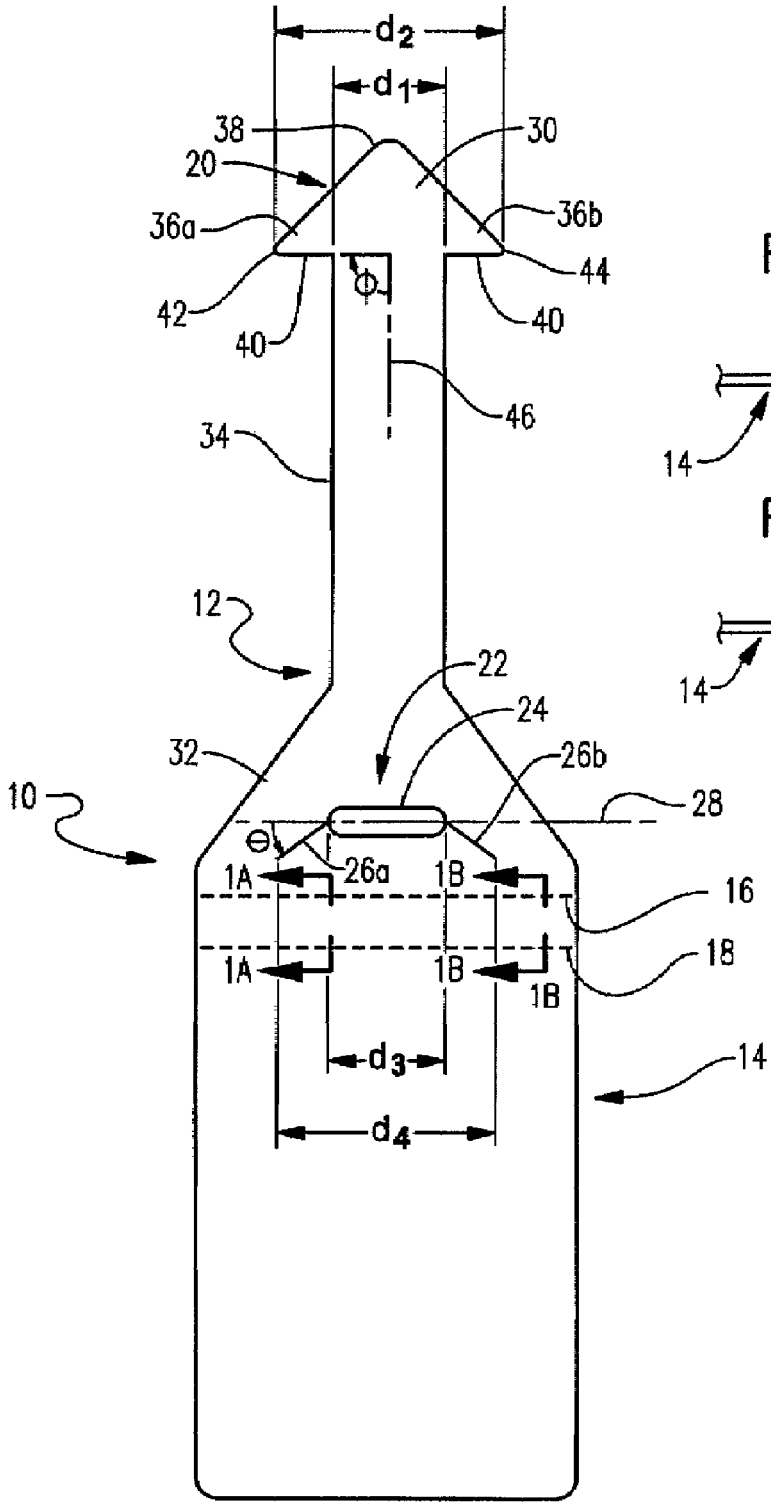
FIG. 1 illustrates a preferred, non-limiting article of the subject invention.

With general reference now to FIG. 1, a promotional hang tag 10 broadly includes "clasping" 12 and "flag" 14 portions, and advantageously, but not necessarily, includes a line-of-weakness (e.g., a perforation 16 or functional equivalent thereof), delimiting the portions 12, 14 in furtherance of disengaging the flag portion 14 (e.g., a coupon) from the clasping portion 12. It is to be understood that the terms "clasping" and "flag" have been selected as convenient monikers, intended only to evoke a functionality for the designated portion of the article, with an intent that those terms be given their maximum breadth of meaning throughout the subject disclosure.

Figure 1A:
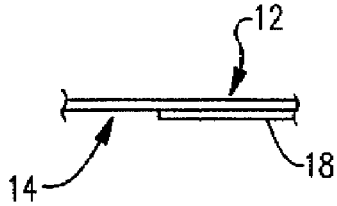
FIGS. 1A & 1B represent partial sections corresponding to lines 1A-1A and 1B-1B of FIG. 1.
Figure 1B:
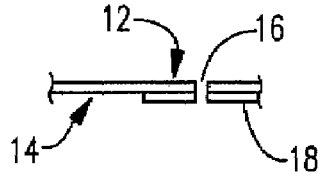

Selectively, the article 10 includes a reinforcing element, e.g., an over-laminate 18, as shown in FIGS. 1, 1A, & 1B. Advantageously, the over-laminate 18 extends throughout and beyond the expanse of the clasping portion 12 of the article 10, more particularly to a point adjacent yet including the line-of-weakness 16. With such arrangement, disintegration of the flag 14 from the remainder of the article 10, i.e., the clasping portion 12, is facilitated.

The clasping portion 12 of the article 10 generally includes an anchor 20 and an anchor retainer 22 comprised of an elongate slot 24 and opposingly paired slits 26*a*, 26*b* extending from opposing ends of the elongate slot 24. The elongate slot 24 is generally characterized by an axis of elongation 28, and is generally dimensioned to receive a free or distal end portion 30 of the anchor 20. The anchor 20, as will be subsequently detailed, is received by the anchor retainer 22 and retained within the elongate slot 24 thereof. Although not illustrated, it is likewise contemplated that the anchor comprise an elongate slit (i.e., primary slit) in lieu of a feature wherein material has been removed, with opposingly paired subordinate or secondary slits depending from opposing ends thereof. Moreover, it is likewise contemplated that the anchor comprise opposingly paired slots (i.e., subordinate or secondary slots) depending from opposing ends of the elongate slot (i.e., primary slot) of the anchor retainer in lieu of a feature wherein no material has been removed.

The "flag" portion 14, or more broadly, the primary or detailed message conveyance portion of the article is intended to be eye-catching, attention-grabbing, memorable, and/or tantalizing. It should be readily appreciated that in as much as a given configuration for the flag is illustrated in FIG. 1, the subject invention need not be so limited. For instance, the flag is advantageous geometrically shaped or configured, e.g., as a square, rectangle, triangle, circle, oval, however, fanciful configurations, e.g., tear-drop, bottle, race-car, sports ball, etc., are likewise contemplated.

Functionally, the flag 14 advantageously, but not necessarily, includes an advertisement, promotion, cross-promotion, coupon or other "offer" or indicia related to the product (e.g., without limitation, a bar code, product look up number, etc.) or cross promoted product. Furthermore, the flag 14 may be readily adapted, as for example via the application of write-on varnishes during press operations, so as to receive post production indicia (e.g., markings, data, information, etc.).

To the extent it is advantageous for a consumer to possess the flag 14, or one or more portions thereof, apart from the article 10, means for disintegrating the flag 14 from the clasp portion 12 is contemplated. For example, in a "snack-sack" setting, an intended primary viewing surface of the flag might include words and/or images (e.g., a branded character, trademark, etc. associated with the snack) touting the availability of a complimentary item, such as "FREE 2-liter soda!", with an opposing, subordinate viewing surface including the nature/details of the offer, e.g., consumer and retailer limitations/conditions etc.

As to the clasp or clasping portion 12 of the article 10, the anchor 20 substantially corresponds to a free end thereof (e.g., a barbed free end), with the anchor retainer 22 substantially corresponding to an end opposite the free end thereof (i.e., a segment of the clasping portion immediately adjacent the flag, more particularly, as shown, the segment immediately adjacent the line-of-weakness, e.g., a clasp base 32). As shown, the free end and flag end segments of the clasping portion 12 of the article 10 are joined, i.e., spaced apart, by an elongate segment, e.g., a strap or neck 34. As should be readily appreciated, a variety of select spacings between the opposing end segments of the clasping portion 12 are believed advantageous, with selection primarily a function of the sought after presentation (i.e., dangle) aesthetic.

The free end portion or anchor 20 of the clasping portion 12, as shown, is preferably, but not necessarily, configured as an "arrowhead," i.e., the free end portion generally includes converging side edges 36*a*, 36*b* which unite to form a blunt tip or vertex 38, the anchor 20 generally characterized by dimension $d_1$. The transition between the strap 34 of the clasping portion 12 and the anchor 20 thereof is advantageously delimited by base forming anchor shoulders 40 characterized by dimension $d_2$ (i.e., the distance between vertex points 42, 44). In-as-much as the shoulders 40, as shown, form a right angle with an axis of elongation of the strap 46, they need not be so angularly limited, e.g., a variety of acute angles $\phi$ are contemplated, namely, without limitation, those in a range of about 45-90° from the axis of strap elongation 46.

As previously noted, the base 32 of the clasping portion 12 of the article 10 generally includes the anchor retainer 22. The aperture thereof, e.g., elongate slot 24 as shown, generally includes opposing ends, and is characterized by dimension $d_3$. The opposingly paired slits 26*a*, 26*b* of the anchor retainer 22 extend from the opposing ends of the elongate aperture 24, with dimension $d_4$ generally associated with the slits 26*a*, 26*b*, more particularly, as shown, delimiting a distance between free ends thereof. Advantageously, the slits 26*a*, 26*b* are in an angular relationship $\theta$ to an axis of elongation 28 of the aperture 24, namely, within the range of about 5-60° therefrom, with 30° as shown, providing supreme utility.

The aperture 24 is generally dimensioned to receive at least a portion of the free end of the clasping portion 12 (i.e., "leading" or distal most end portion or segment 30), and accommodate the width of the neck or strap 34 therethrough (i.e., permit unencumbered reversible passage of the strap 34). As to the slits 26*a*, 26*b*, functionally, they permit ingress of the entirety of the anchor 20 of the clasp portion 12 into and through the aperture 24, the shoulders 40 latchingly engaging surfaces of the clasping portion 12 adjacent the opposing ends of the aperture 24 so as to be retained via cooperative engagement therewith (i.e., once received through the aperture 24, the shoulders 40 no longer register with the opposing slits 26*a*, 26*b*, the arrowhead 20 thereby effectively "trapped" on a side of the clasp portion 12 opposite the side through which the arrowhead passes).

Figure 2:
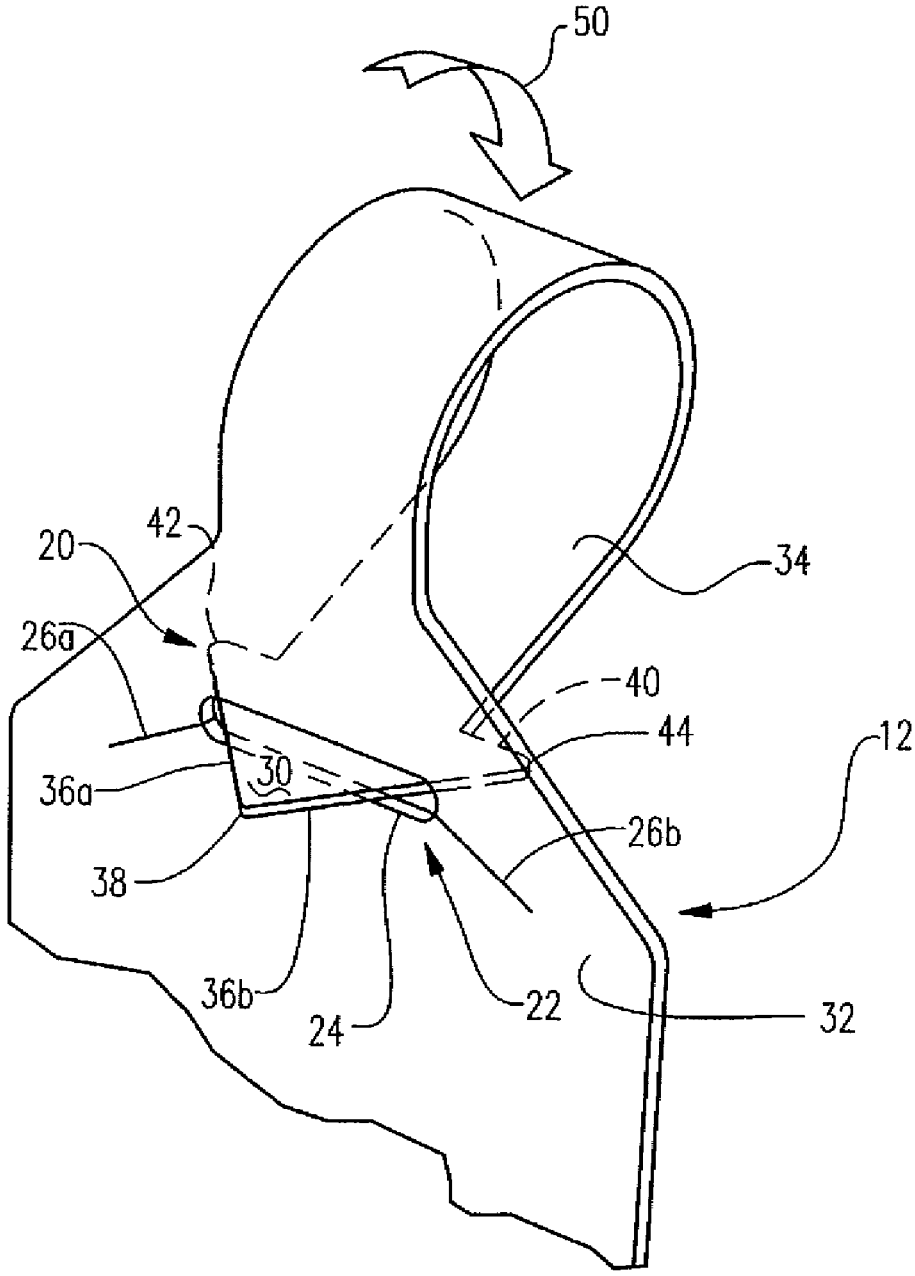
FIG. 2 depicts, in fragmentary perspective, a strap portion of the article of FIG. 1, more particularly, initial receipt of an anchor within an elongate slot of an anchor retainer.
Figure 3:
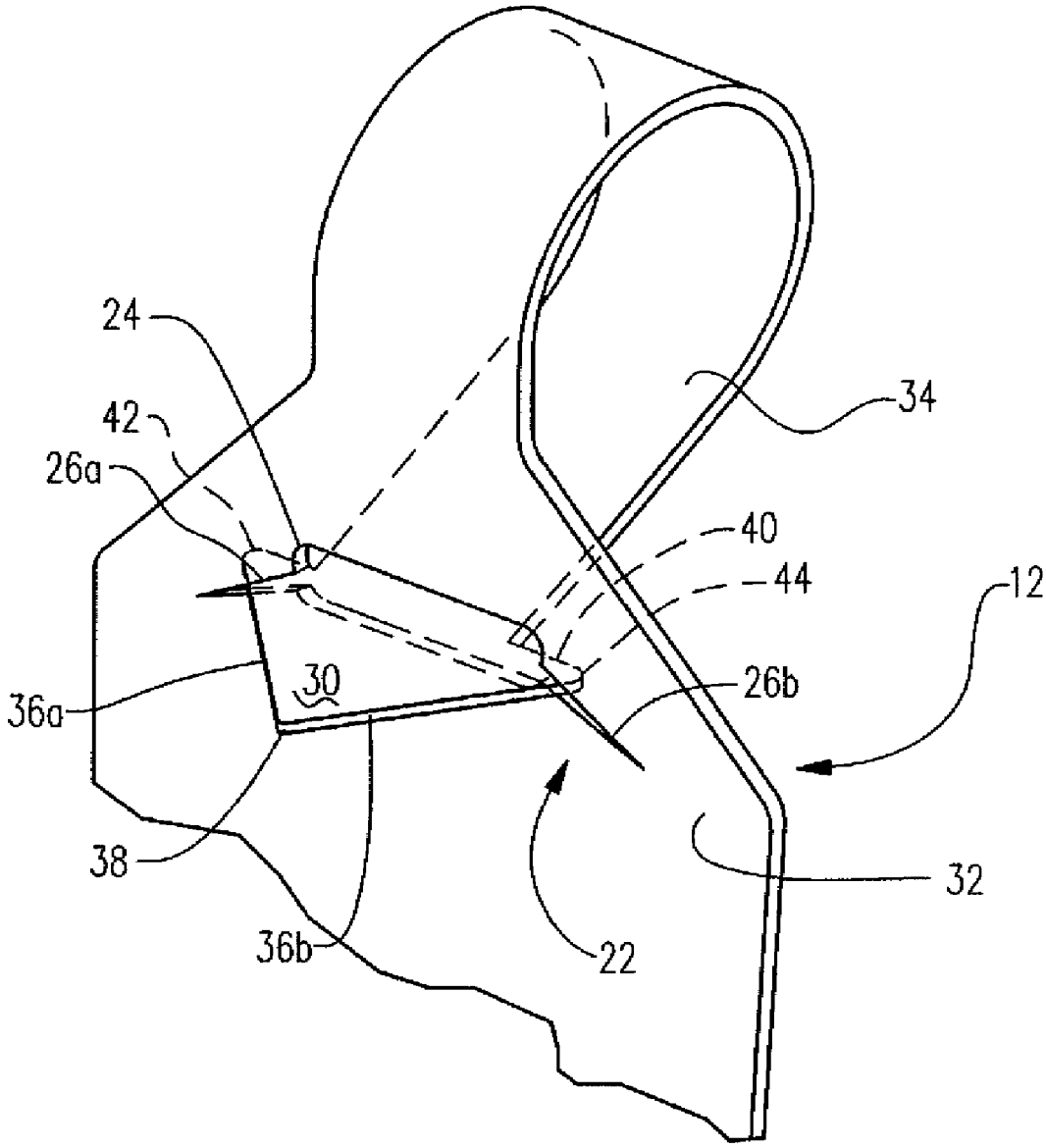
FIG. 3, consistent with FIG. 2, depicts further progressive receipt of the anchor within the elongate slot of the anchor retainer, more particularly, receipt of anchor portions by and through slits of the anchor retainer; and, FIG. 4, consistent with FIG. 3, depicts receipt and retention of the anchor within the elongate slot of the anchor retainer, more particularly, a locking abutting engagement of the anchor relative to the anchor retainer.
Figure 4:
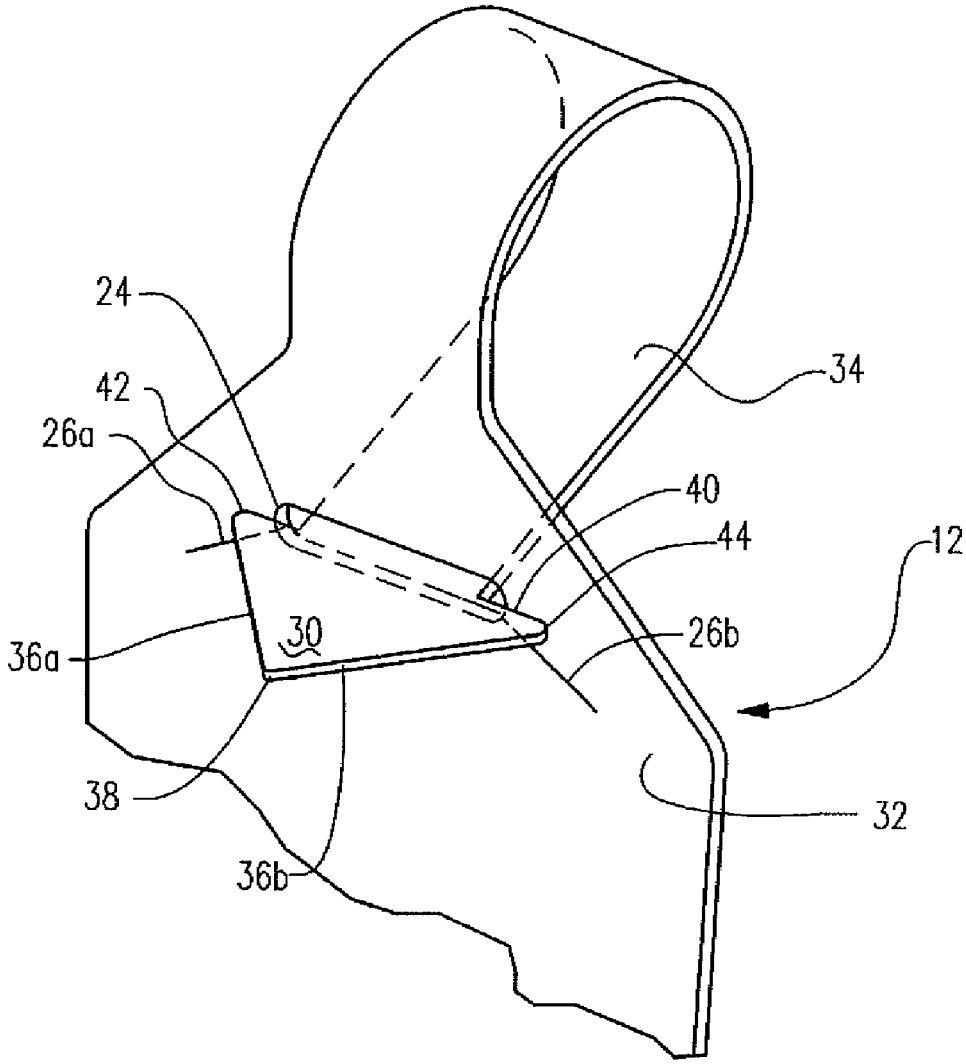

With particular reference now to FIGS. 2-4, the aforementioned relationships and interrelationships are progressively illustrated. Initially, the anchor 20, via bending of the strap segment 34 "into the paper," as indicated by arrow 50, or otherwise, is introduced into and through the elongate slot, more particularly, portion 30 thereof distal of $d_2$ as shown (FIG. 2).

Thereafter, as the anchor 20 is advanced into the elongate slot 24 beyond $d_2$ (FIG. 3), the opposingly paired slits 26*a*, 26*b* are engaged by that portion of the anchor 20 proximal of $d_2$, i.e., segments of the converging side edges 36*a*, 36*b* of the free end proximal of $d_2$, so as to initiate passage of the remainder of the anchor 20 through the elongate slot 24. With passage of the shoulders 40 of the anchor 20 through the anchor retainer 22 (FIG. 4), the strap 34 resides within the elongate slot 24 (i.e., $d_3$), with the shoulders 40 abutting portions of the base 32 of the clasping portion 12, more particularly, abutting portions laterally adjacent the opposing ends of the elongate slot 24.

Although not essential, it is advantageous that clasping portion 12, more particularly, strap 34 thereof, be resilient such that a tension is imparted upon and/or between the cooperative elements of portion 12 (FIGS. 2-4). More particularly, it is advantageous for there to exists a tension between the anchor 20 and the anchor retainer 22, more particularly still, between the shoulders 40 of the anchor 20 and the area surrounding or adjacent the aperture 24 (FIG. 4). A variety of constructs and/or fabrications are known to accomplish such functionality for the article, namely, a functionally reliable integration of elements which, among other things, results in a supremely neat appearance.

Generally, the subject promotional hang tag comprises a baseboard stock or synthetic material, advantageously with an over-laminate, for instance a 0.5 mil thick self-wound material, or up to a 4-5 mil thick liner supported clear synthetic stock to give strength to the article, and more particularly, aid disintegration of a coupon or the like from the clasping portion about the merchandise. Features of the anchor retainer, and line of separation, are advantageously imparted via die cutting or the like.

Paper weight stocks, board, text weight paper and synthetic films are contemplated and suitable for manufacture of the article of the subject invention, including variants thereof. Advantageous, non-limiting preferred materials include 8pt C1S board stock, 100# text weight, and/or 10 mil white polypropylene. It is intended that the article bear printing, as by printing on either sheet fed presses or web presses with virtually any kind of printing system, including, but not limited to, UV cured, water-based, heat-set, flexography, lithographic, offset, and or digital.

With regard to over-laminates, selective utilization is contemplated as previously noted, namely, for among other considerations, fortifying the article or select portions thereof (e.g., the clasping portion thereof). It is contemplated that the over-laminate consist of a variety of widely known material substrates of effective thickness, e.g., 0.8 mil to upwards of 4 mils, with over-laminate specifics again a function of tagging environment/application. Finally, it is to be noted that the over-laminate can be self-wound, or even supported upon a liner.

Relative to alternatives, it is contemplated that the article of the subject inventions, and variants thereof, may be fabricated of multiple plies of material in furtherance of thereby forming a pouch, pocket, etc. for delivering items such as, without limitation, game pieces, premiums, additional/multiple coupons, rebate offers, internet PIN codes, products samples, etc. It is believed advantageous to fold a multi-ply construct, i.e., the article in its entirety, or a portion thereof, on press so as to create a sealed pouch or pocket for "opening" post merchandise purchase. Articles might likewise be adapted, e.g., via addition of one or more further plies to a "base" in furtherance of supplying a multiplicity of flags or coupons to be delivered in a single promotional article. Further still, one or more separate pressure-sensitive promotional constructs may be suitably carried, i.e., affixed for selective removal, by a base or other element of the promotional article in furtherance of satisfying growing demand for overlay promotions.

It is to be understood that there are other variations of the subject invention, some of which will become obvious to those skilled in the art. Furthermore, in-as-much as "handled" articles of manufacture may be readily equipped with the article of the subject invention, a boundless variety of items, goods, and/or merchandise may be likewise so equipped. Furthermore, the anchoring or clasping relationships described and shown, including adaptations thereof, are believed to have utility in other tagging environments and/or devices, for example and without limitation, produce (e.g., and especially, stalked items such as asparagus), bag mouth ties (e.g., bread), poultry ties, cable ties, etc.

Finally, it is to further be understood that this disclosure, in many respects, is only illustrative. Changes may be made in details, particularly in matters of shape, size, material, and arrangement of parts, as the case may be, without exceeding the scope of the invention.

What is claimed is:

1. A point-of-purchase promotional article comprising a strap portion, an information conveyance portion separable from said strap portion via a line-of-weakness, and an over-laminate, wherein said over-laminate is co-extensive with an entire surface of said strap portion and extends across said line-of-weakness, said over-laminate terminating at a position adjacent said line-of-weakness so that said over-laminate is co-extensive with less than an entire surface of said information conveyance portion, said strap portion includes a terminal barbed anchor and an anchor keeper for receipt of said terminal barbed anchor therethrough, said anchor keeper comprising an elongate slot characterized by opposingly paired slits angularly extending from first and second opposing ends of said elongate slot towards said line-of-weakness, a free end of said terminal barbed anchor being progressively received within said elongate slot of said anchor keeper with barbs of said terminal barbed anchor thereafter passing through said opposingly paired slits, said terminal barbed anchor subsequently forming a self-tensioned interference fit with said elongate slot of said anchor keeper.

2. The point-of-purchase promotional article of claim 1 wherein slits of said opposingly paired slits comprise cuts extending from said slot wherein material is not removed.

3. The point-of-purchase promotional article of claim 1 wherein said information conveyance portion is adapted to carry a pressure sensitive promotional construct.

4. The point-of-purchase promotional article of claim 1 wherein said terminal barbed anchor is characterized by a vertex, and a base opposite said vertex.

5. The point-of-purchase promotional article of claim 4 wherein a dimension of said base of said terminal barbed anchor exceeds a maximum dimension of said elongate slot of said anchor keeper.

6. The point-of-purchase promotional article of claim 4 wherein a dimension of said base of said anchor substantially equates to a dimension extending between free ends of said opposingly paired slits of said anchor keeper.

* * * * *